US008027625B2

(12) United States Patent
Kawashima

(10) Patent No.: US 8,027,625 B2
(45) Date of Patent: Sep. 27, 2011

(54) DEVELOPER SUPPORTING MEMBER, DEVELOPING ROLLER, DEVELOPING DEVICE, AND IMAGE FORMING APPARATUS

(75) Inventor: Junichi Kawashima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/639,145

(22) Filed: Dec. 16, 2009

(65) Prior Publication Data

US 2010/0166459 A1 Jul. 1, 2010

(30) Foreign Application Priority Data

Dec. 25, 2008 (JP) ..... 2008-328973

(51) Int. Cl.
*G03G 15/08* (2006.01)

(52) U.S. Cl. ..... 399/286

(58) Field of Classification Search ..... 399/252, 399/265, 279, 286; 492/48, 49, 53, 56, 59
See application file for complete search history.

(56) References Cited

U.S. PATENT DOCUMENTS 4,910,556 A * 3/1990 Namiki ..... 399/286
6,953,421 B2 * 10/2005 Tsunemi et al. ..... 492/56

FOREIGN PATENT DOCUMENTS

JP 2005-148470 A 6/2005

* cited by examiner

*Primary Examiner* — Hoan Tran
(74) *Attorney, Agent, or Firm* — Kubotera & Associates, LLC

(57) ABSTRACT

A developer supporting member includes a supporting layer for supporting developer. The supporting layer has a corona discharge resistivity of a specific value. The supporting layer is formed of an elastic layer and a surface layer. The surface layer includes a surface treated with a urethane solution.

16 Claims, 5 Drawing Sheets

DEVELOPER SUPPORTING MEMBER, DEVELOPING ROLLER, DEVELOPING DEVICE, AND IMAGE FORMING APPARATUS

BACKGROUND OF THE INVENTION AND RELATED ART STATEMENT

The present invention relates to a developer supporting member for developing a static latent image on a photosensitive drum, a developing roller using the developer supporting member, a developing device, and an image forming apparatus.

In a conventional image forming apparatus of an electrophotography type, a developing roller and a toner supply roller charge toner through friction, so that toner adheres to a circumferential surface of the developing roller. Then, the developing roller transports toner to a photosensitive drum as an image supporting member. Accordingly, toner adheres to a static latent image on a circumferential surface of the photosensitive drum, so that the static latent image is visualized.

In the conventional image forming apparatus, the developing roller is formed of a conductive shaft and a semi-conductive elastic layer disposed on a circumferential surface of the conductive shaft. The elastic layer is formed of a rubber material such as a urethane rubber, an NBR, an EPDM, a silicone rubber and the like containing an ion conductive agent or an electron conductive agent such as carbon, a conductive filler, and the like.

In the conventional image forming apparatus, a surface of the developing roller is treated with a charging agent, a surface modification agent, and the like, so that toner is easily charged or the photosensitive drum is not stained through a chemical reaction. The surface treatment uses a material with small compressive permanent strain, that is, a material in which a nip imprint is difficult to form under a state pressed against the photosensitive drum for a long period of time.

Patent Reference has disclosed a technology of forming a surface treated layer with small compressive permanent strain. In the technology, a surface of an elastic layer formed of a urethane rubber with high ion conductivity is treated with an isocyanate solution.

Patent Reference: Japanese Patent Publication No. 2005-148470

In the conventional image forming apparatus, a developing blade is provided to slide against the circumferential surface of the developing roller. Further, a sealing member is provided to slide against the circumferential surface of the developing roller for preventing toner from scattering outside a casing of a fixing device. Accordingly, the circumferential surface of the developing roller is divided into two portions facing outside and inside of the casing with the developing blade and the sealing member.

In the conventional image forming apparatus, when the developing device starts operating, a surface potential of the developing roller increases. When the developing device stops operating, the surface potential of the developing roller gradually decreases due to external moisture. In this case, the portion facing inside of the casing contacts with toner over an area larger than that of the portion facing outside of the casing. Accordingly, in the portion facing inside of the casing, the surface potential of the developing roller decreases more gradually due to external moisture. As a result, when the developing device stops operating for a long period of time, a difference may be generated in the surface potential of the developing roller, so that a density variance may occur in an image. In other words, when the developing device stops operating for a long period of time, a density variance in a bad shape (refer to an idle lateral band) may be generated with an interval corresponding to a circumferential length of the developing roller when the developing device resumes operating.

In view of the problems described above, an object of the present invention is to provide a developer supporting member capable of preventing the idle lateral band. Another object of the present invention is to provide a developing roller using the developer supporting member, a developing device, and an image forming apparatus.

Further objects of the invention will be apparent from the following description of the invention.

SUMMARY OF THE INVENTION

In order to attain the objects described above, according to a first aspect of the present invention, a developer supporting member includes a supporting layer for supporting developer. The supporting layer has a corona discharge resistivity of a specific value.

According to a second aspect of the present invention, a developing roller is formed of a conductive shaft and the developer supporting member disposed on a circumference of the conductive shaft.

According to a third aspect of the present invention, a developing device includes the developing roller.

According to a fourth aspect of the present invention, an image forming apparatus includes the developing device and a transfer device for transferring a developer image developed with the developing device to a recording medium.

In the present invention, it is possible to easily move surface charges of the supporting layer of the developer supporting member. Accordingly, the surface charges of the supporting layer of the developer supporting member easily move to a conductive portion of the developer supporting member. As a result, even when the image forming apparatus stops operating for a long period of time, it is possible to prevent a difference in a surface potential of a developing roller, and to prevent an idle lateral band.

Further, in the present invention, the corona discharge resistivity, not a partial resistivity, defines an upper limit for preventing the idle lateral band. Accordingly, it is possible to reduce a variance in the upper limit due to a difference in a material of an elastic layer, thereby improving applicability.

DETAILED DESCRIPTION OF THE PREFERRED EMBODIMENTS

Hereunder, embodiments of the present invention will be described in detail with reference to the accompanying drawings.

First Embodiment

Figure 1:
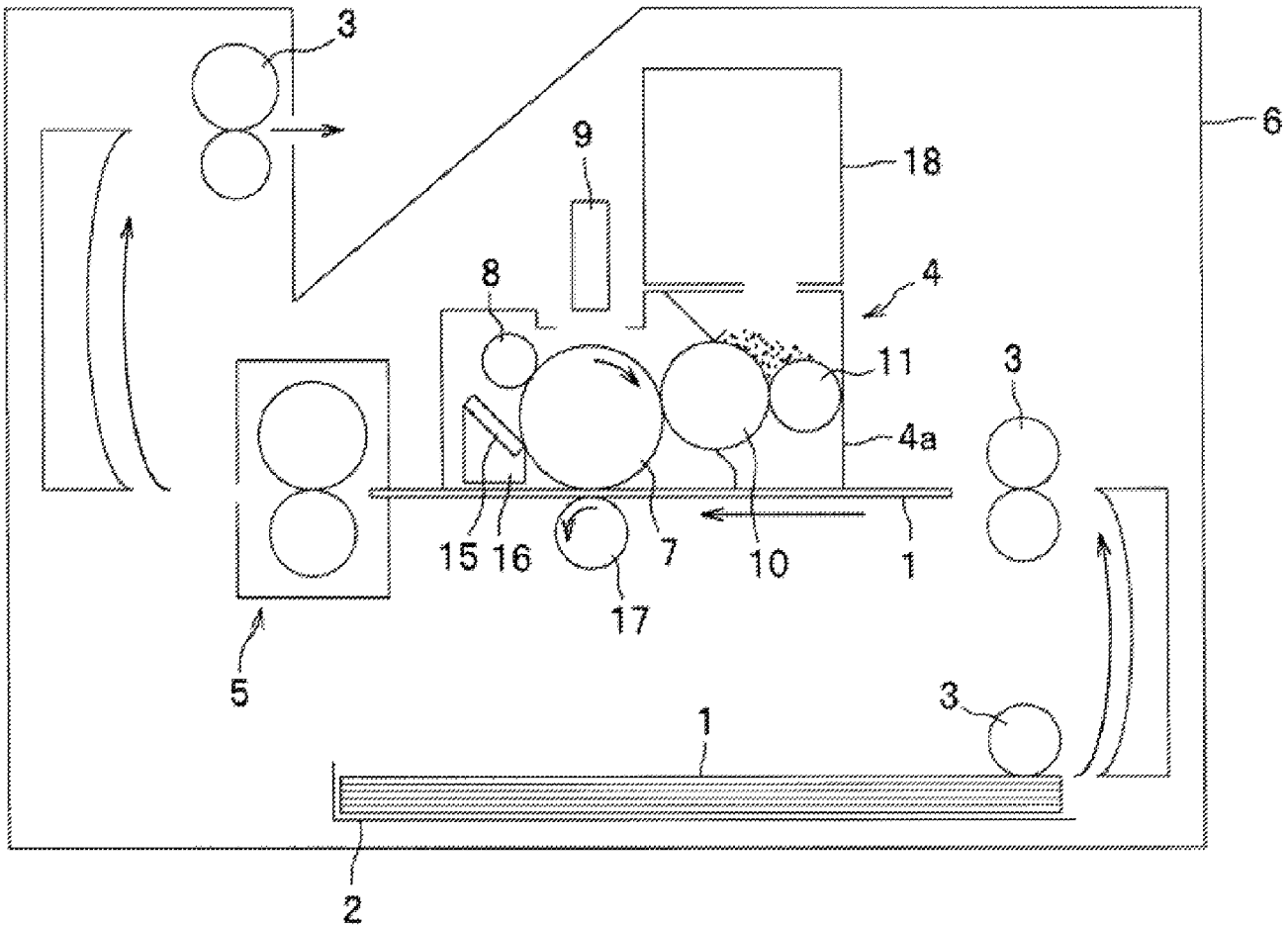
FIG. 1 is a schematic sectional view showing an image forming apparatus according to a first embodiment of the present invention.
Figure 2:
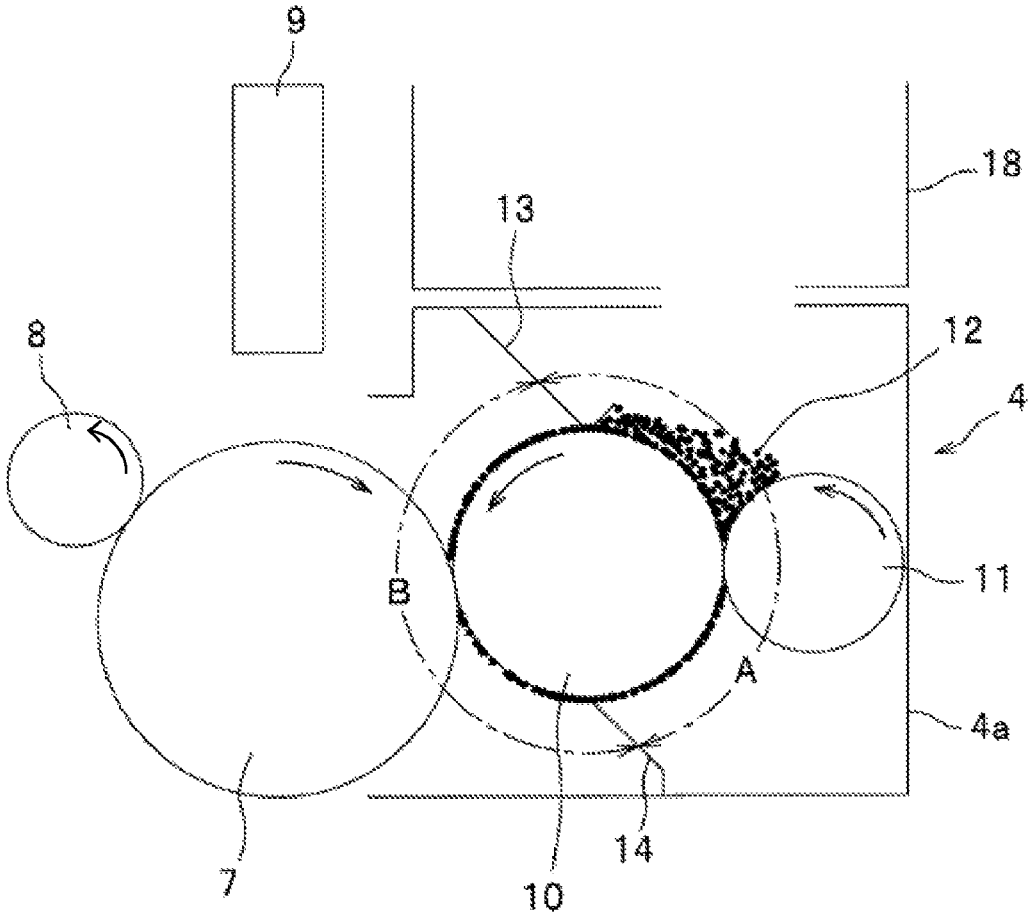
FIG. 2 is a schematic enlarged view showing a developing device of the image forming apparatus according to the first embodiment of the present invention.
Figure 3:
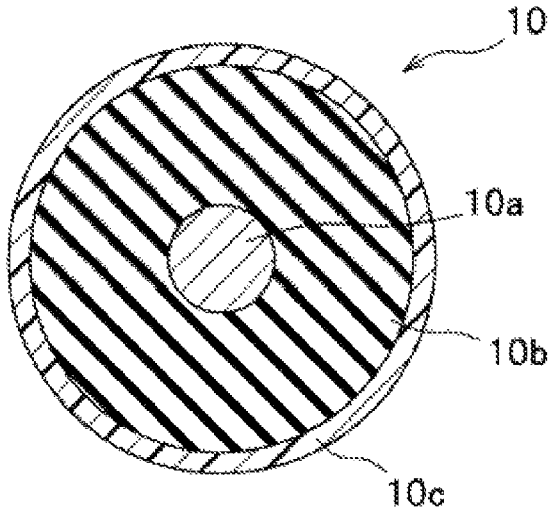
FIG. 3 is a schematic sectional view showing the developing device according to the first embodiment of the present invention.

A first embodiment of the present invention will be explained. FIG. 1 is a schematic sectional view showing an image forming apparatus according to the first embodiment of the present invention. FIG. 2 is a schematic enlarged view showing a developing device 4 of the image forming apparatus according to the first embodiment of the present invention. FIG. 3 is a schematic sectional view showing the developing device 4 according to the first embodiment of the present invention.

Figure 4:
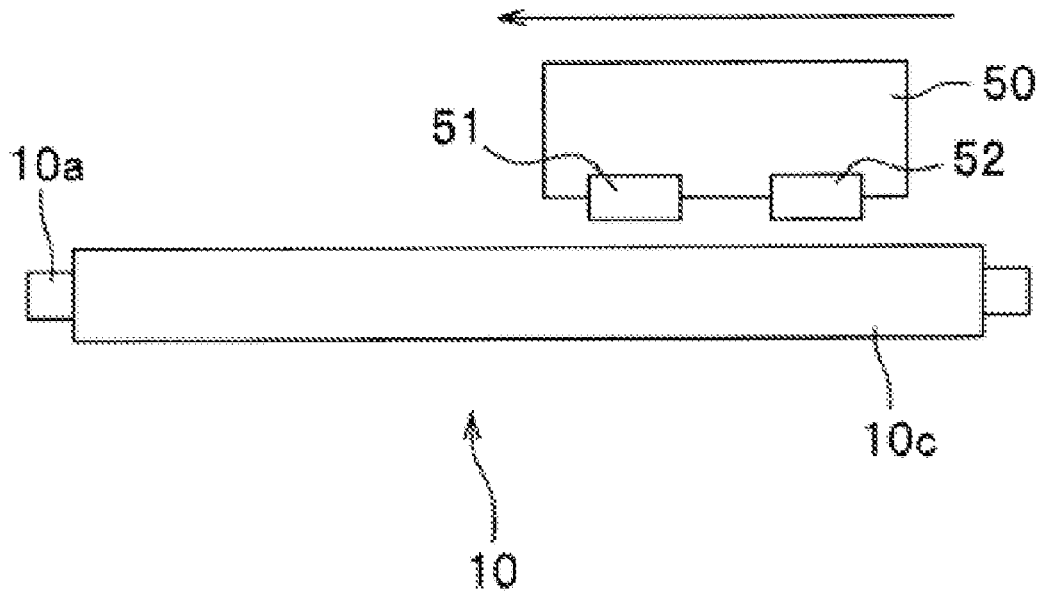
FIG. 4 is a schematic view showing a method of measuring a corona discharge resistivity of a developing roller according to the first embodiment of the present invention.
Figure 5:
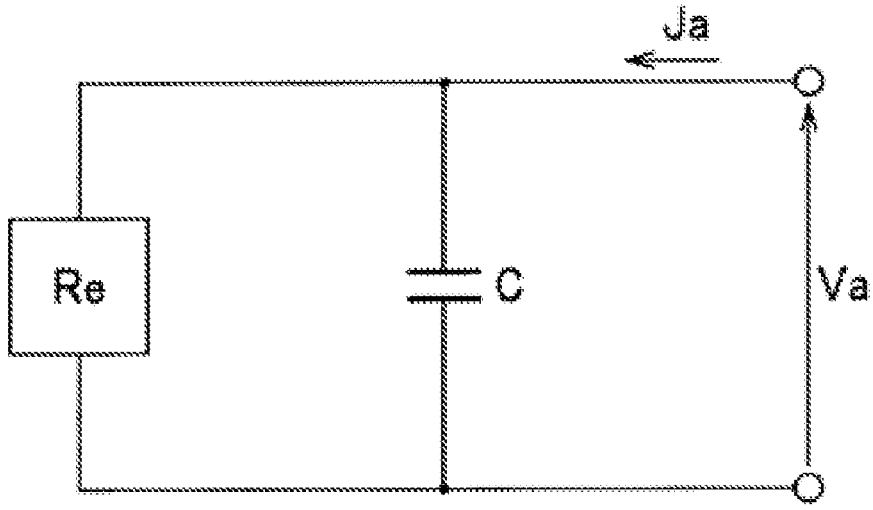
FIG. 5 is a circuit diagram showing an equivalent circuit for measuring the corona discharge resistivity of the developing roller according to the first embodiment of the present invention.
Figure 6:
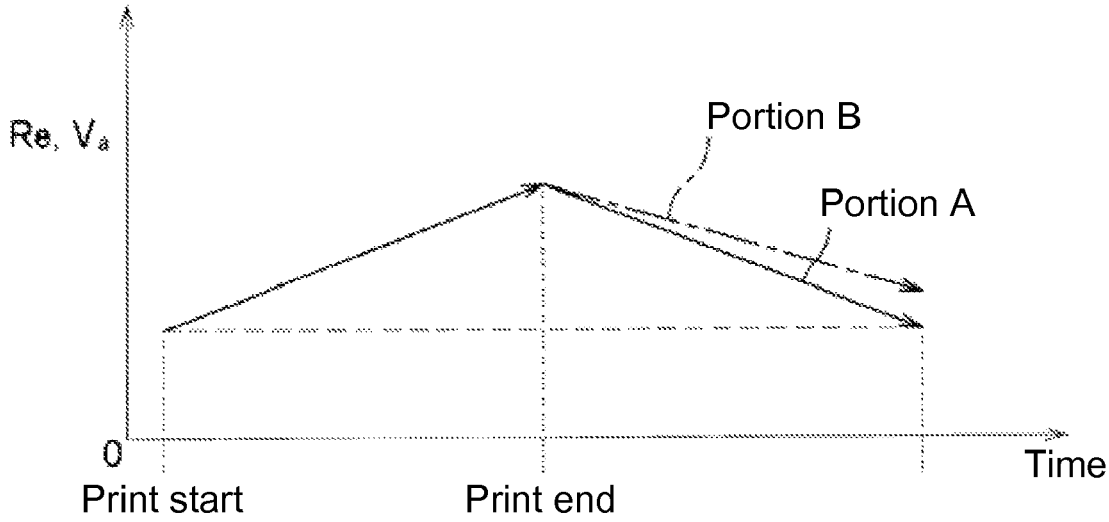
FIG. 6 is a graph showing a change in the corona discharge resistivity of the developing roller according to the first embodiment of the present invention.

FIG. 4 is a schematic view showing a method of measuring a corona discharge resistivity of a developing roller 10 according to the first embodiment of the present invention. FIG. 5 is a circuit diagram showing an equivalent circuit for measuring the corona discharge resistivity of the developing roller 10 according to the first embodiment of the present invention. FIG. 6 is a graph showing a change in the corona discharge resistivity of the developing roller 10 according to the first embodiment of the present invention.

Figure 7:
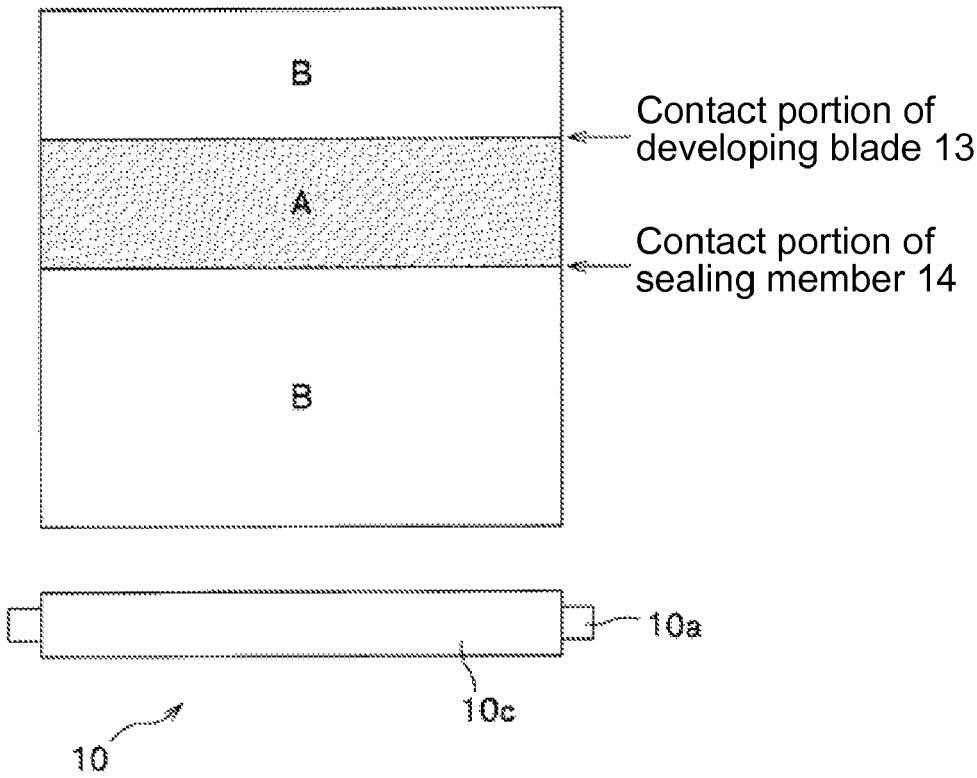
FIG. 7 is a schematic exploded view showing a distribution of the corona discharge resistivity of the developing roller according to the first embodiment of the present invention.
Figure 8:
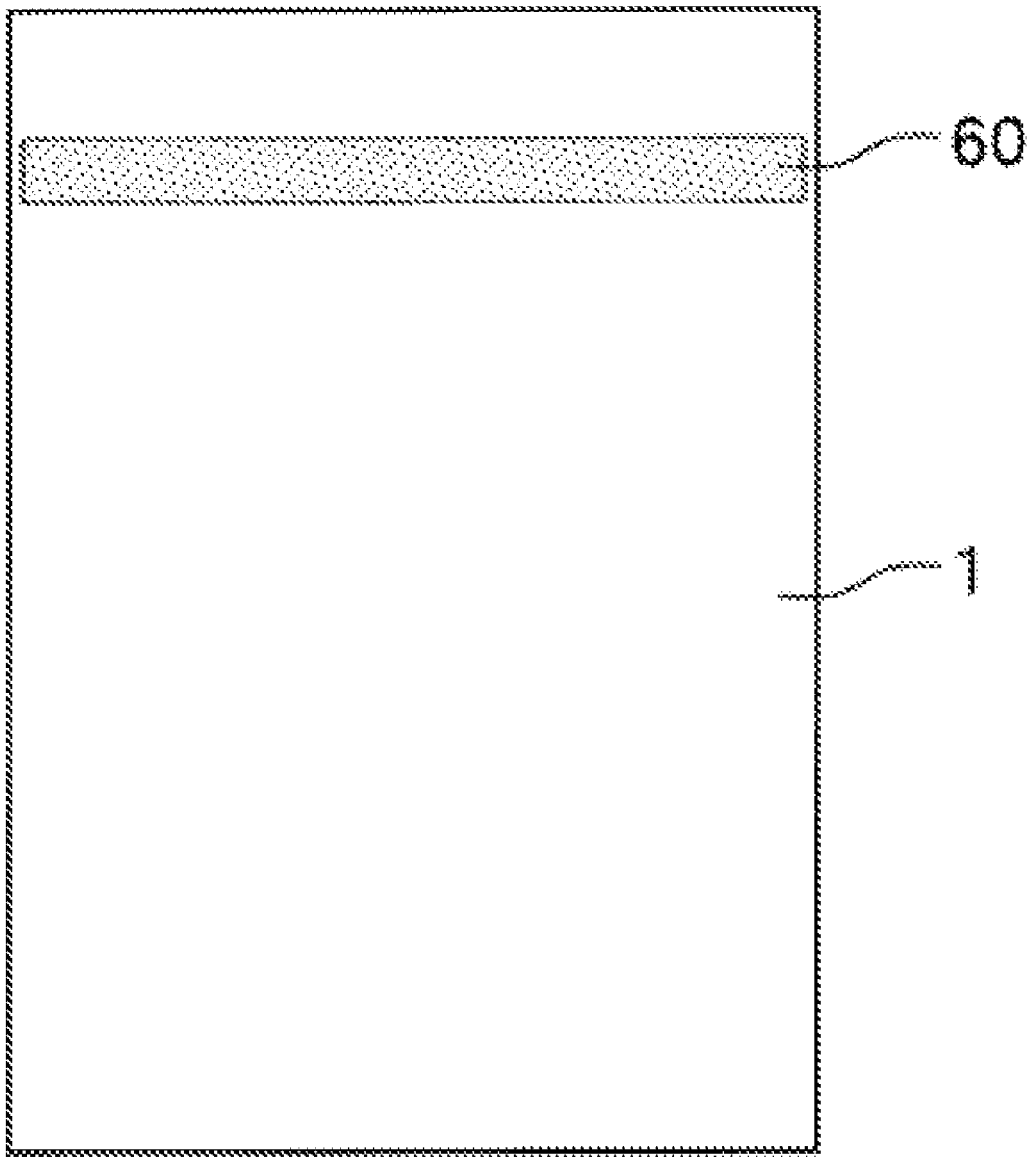
FIG. 8 is a schematic view showing a print pattern of the image forming apparatus according to the first embodiment of the present invention.

FIG. 7 is a schematic exploded view showing a distribution of the corona discharge resistivity of the developing roller 10 according to the first embodiment of the present invention. FIG. 8 is a schematic view showing a print pattern of the image forming apparatus according to the first embodiment of the present invention.

As shown in FIG. 1, in the image forming apparatus, a recording sheet 1 as a recording medium is retained in a sheet supply cassette 2. A transportation roller 3 is provided for transporting the recording sheet 1 to a developing device 4. The developing device 4 forms an image on the recording sheet 1. After the image is formed on the recording sheet 1, the recording sheet 1 is discharged to an upper portion of a housing 6 through a fixing device 5.

FIG. 2 is the schematic enlarged view showing the developing device 4. A photosensitive drum 7 is formed of a conductive supporting member and an optical conductive layer, and rotates in an arrow direction with a drive mechanism (not shown). The conductive supporting member is formed of an aluminum body, and the optical conductive layer is formed of an organic photosensitive member having a laminated structure of a charge generation layer and a charge transportation layer.

In the embodiment, a charge roller 8 is formed of a metal shaft and a semi-conductive epichlorohydrin rubber layer covering the metal shaft. An LED (Light Emitting Diode) head 9 is provided as an exposure device, and is arranged to face the photosensitive drum 7. The developing roller 10 is provided as a developer supporting member for supporting toner 12 as developer.

As shown in FIG. 3, the developing roller 10 is formed of a metal shaft 10*a* and an elastic layer 10*b* formed of a foamed material covering a circumference of the metal shaft 10*a*. A surface treated layer 10*c* is formed as a surface layer on a surface of the elastic layer 10*b*. The developing roller 10 is arranged to press against a circumferential surface of the photosensitive drum 7 (refer to FIG. 2). A toner supply roller 11 is arranged to press against a circumferential surface of the developing roller 10 (refer to FIG. 2). The toner supply roller 11 is formed of a metal shaft and a foamed layer covering a circumference of the metal shaft. The developing roller 10 and the toner supply roller 11 are connected to different drive units, and rotate in a same direction.

In the embodiment, the toner 12 is formed of a polyester resin as a binder resin, an inner additive, a charge control agent, a releasing agent, a colorant, and silica as an outer additive. A developing blade 13 is provided as a thin layer forming member for forming a toner layer with a uniform thickness on the developing roller 10. The developing blade 13 is disposed in a casing 4*a* of the developing device 4 above the developing roller 10, and is arranged to slide against the circumferential surface of the developing roller 10 at a distal end portion thereof. A sealing member 14 is provided below the developing roller 10 for preventing the toner 12 from scattering outside the casing 4*a*. The sealing member 14 is arranged to slide against the circumferential surface of the developing roller 10 at a distal end portion thereof. A cleaning blade 15 is provided for scraping off the toner 12 remaining on the photosensitive drum 7, so that the toner 12 thus scraped off is collected in a container 16 (refer to FIG. 1).

An operation of the developing device 4 will be explained next. A drive unit (not shown) drives the photosensitive drum 7 to rotate in an arrow direction. The charging roller 8 contacts with the photosensitive drum 7 to rotate in an arrow direction through friction. A direct current power source (not shown) applies a voltage to the charge roller 8, so that the charge roller 8 charges the photosensitive drum 7. The LED head 9 exposes the photosensitive drum 7 thus charged with the charge roller 8, thereby forming a static latent image.

In the embodiment, the toner supply roller 11 rotates in an arrow direction through a drive mechanism (not shown) while contacting with the developing roller 10, so that the toner supply roller 11 charges the toner 12 through friction generated by the contact with the developing roller 10, thereby adhering the toner 12 to the developing roller 10. Note that the toner supply roller 11 is provided for scraping the toner 12 not developed from the developing roller 10 to the photosensitive drum 7, so that a constant state of the toner 12 on the developing roller 10 is maintained.

In the embodiment, the developing blade 13 is provided for forming a thin layer of the toner 12 supplied to the developing roller 10 with the toner supply roller 11. Further, a transfer roller 17 rotates in an arrow direction through a drive mechanism (not shown) while contacting with the photosensitive drum 7. Further, a power source (not shown) applies a voltage to the transfer roller 17, so that the toner image thus visualized on the photosensitive drum 7 is transferred to the recording sheet 1. The cleaning blade 15 is provided for removing the toner 12 remaining on the photosensitive drum 7. The fixing device 5 is provided for fixing the toner image thus transferred to the recording sheet 1. A toner cartridge 18 is provided for retaining the toner 12, so that the toner 12 is supplied to the developing device 4 through own weight (refer to FIG. 1).

A configuration of the developing roller 10 will be explained in detail next. As shown in FIG. 3, the developing roller 10 includes the metal shaft 10*a* as a conductive portion for applying a voltage to the developing roller 10 from a voltage applying portion (not shown). Further, the developing roller 10 includes the elastic layer 10*b* disposed on the circumference of the metal shaft 10*a*, and the surface treated layer 10*c* as the surface layer on the surface of the elastic layer 10*b*. The surface treated layer 10*c* is formed through a surface treatment such as a dipping method using a charging property agent, a surface modification agent, and the like.

In the embodiment, a specific amount of a conductive agent (for example, carbon black) formed of one or more types of electron conductive materials is added to and uniformly dispersed in a urethane rubber as an elastic material, thereby forming the elastic layer 10*b*. Then, a urethane solution is coated on the surface of the elastic layer 10*a*, and the urethane solution is heated, cured and dried, thereby forming the surface treated layer 10*c*. The surface treated layer 10*c* may be formed using a urethane solution containing fluorine.

In the embodiment, the developing roller 10 may be formed with a well-known method (refer to Patent Reference), and a detail explanation thereof is omitted. Note that the developing roller 10 as the developer supporting member includes a supporting layer formed of the elastic layer 10*a* and the surface treated layer 10*b*. Alternatively, the developing roller 10 may be formed of a plurality of elastic layers or a supporting layer formed of a plurality of layers.

When the surface of the surface treated layer 10*c* is treated using only the urethane solution, the developing roller 10 has a corona discharge resistivity of less than 7.85 log Ω (preferably less than 7.75 log Ω). When the surface of the surface treated layer 10*c* is treated using the urethane solution containing fluorine, the developing roller 10 has the corona discharge resistivity of less than 7.89 log Ω (preferably less than 7.70 log Ω). A method of measuring the corona discharge resistivity will be explained later.

In the embodiment, it is configured such that the elastic layer 10*b* including the surface treated layer 10*c* has a partial resistivity with a lower limit of 5.10 log Ω. When the elastic layer 10*b* has the partial resistivity of less than 5.10 log Ω, charges tend to leak to the photosensitive drum 7. A method of measuring the partial resistivity will be explained later.

The method of measuring the corona discharge resistivity will be explained next. FIG. 4 is a schematic view showing the method of measuring the corona discharge resistivity of the developing roller 10 according to the first embodiment of the present invention. A dielectric relaxation measurement device shown in FIG. 4 is used for measuring the corona discharge resistivity.

As shown in FIG. 4, a carrier 50 is provided with an electrode 51 for generating corona discharge between the electrode 51 and the surface treated layer 10*c* of the developing roller 10, and a probe 52 for detecting surface charges of the developing roller 10. In the measurement, a specific voltage or a corona voltage is applied between the electrode 51 and the metal shaft 10*a* of the developing roller 10, so that corona discharge is generated between the electrode 51 and the surface treated layer 10*c* while the probe 52 is moving along an axial direction of the developing roller 10.

FIG. 5 is a circuit diagram showing an equivalent circuit for measuring the corona discharge resistivity of the developing roller 10 according to the first embodiment of the present invention.

As shown in FIG. 5, when corona discharge is generated between the electrode 51 and the surface treated layer 10*c*, a current Ja flows. An ammeter (not shown) disposed between the electrode 51 and a power source measures the current Ja. Further, the probe 52 detects surface charges of the developing roller 10, thereby determining a surface potential Va. A current flowing through a capacitor C and a voltage at both end portions of the capacitor C decrease with time, and are represented with a time function after the corona voltage is applied. In other words, an apparent resistivity Ra is represented as a ratio of the surface potential Va at a moment that the probe 52 measures charges and the current Ja with the following equation:

$$Ra=Va/Ja$$

In the above equation, the apparent resistivity Ra has an apparent value without consideration of a charge transportation parameter such as a specific charge density and charge mobility of a charged material. The corona discharge resistivity Re is calculated from the value of the apparent resistivity Ra in consideration of a capacitance component, the charge transportation parameter, and the like. More specifically, the corona discharge resistivity Re is represented as a ratio of the surface potential Va and the current Ja, and is defined with the following equations:

$$R_e=V_a/J_a[10^9\Omega/\mathrm{cm}^2]$$

$$V_a=V(t_c)\times(R_eC/t_p)\exp(-t_s/R_eC)[1-\exp(-t_p/R_eC)]$$

$$J_a=J_{mx}(R_b/R_e)\{1+(CR_eR_b/(t_cR_{ch}))[1-\exp(-t_c/CR_b)]\}$$

In the above equations, tc is a corona voltage application time (seconds); C is a capacitance (F); tp is a probe measurement time (seconds); ts is a time from the corona voltage application to the start of the probe measurement (seconds); and Jmx is a maximum current density upon corona charge ($\mu A/cm^2$). The time ts is calculated by dividing a distance between a corona application position and the probe 52 by a carrier movement speed.

In the above equations, Rb and Rch are given by the following equations:

$$R_b=R_e\times R_{ch}/(R_e+R_{ch})[10^9\Omega\mathrm{cm}^2]$$

$$R_{ch}=V_{mx}/J_{mx}[10^9\Omega\mathrm{cm}^2]$$

In the above equation, Vmx is a cut-off voltage (kV).

FIG. 6 is a graph showing a change in the corona discharge resistivity Re of the developing roller 10 according to the first embodiment of the present invention.

As shown in FIG. 6, when the developing device 4 starts operating, the surface potential Va and the corona discharge resistivity Re of the developing roller 10 gradually increase. When the developing device 4 stops operating, the surface potential Va and the corona discharge resistivity Re of the developing roller 10 gradually decrease due to external moisture.

As shown in FIGS. 2 and 7, the circumferential surface of the developing roller 10 is divided into two portions A and B facing outside and inside of the casing 4*a* of the developing device 4 with the developing blade 13 and the sealing member 14. In this case, the portion A facing inside of the casing 4*a* contacts with the toner 12 over an area larger than that of the portion B facing outside of the casing 4*a*. Accordingly, the surface potential Va of the developing roller 10 decreases more gradually in the portion B facing inside of the casing 4*a* than in the portion A facing outside of the casing 4*a* due to external moisture.

As a result, when the developing device 4 stops operating for a long period of time, a difference may be generated in the surface potential Va of the developing roller 10 between the portions A and B facing outside and inside of the casing 4*a*, so that a density variance may occur in an image. In other words, when the developing device 4 stops operating for a long period of time, a density variance in a band shape (refer to an idle lateral band) may occur with an interval corresponding to a circumferential length of the developing roller 10 when the developing device 4 resumes operating.

To this end, in the embodiment, it is configured such that the corona discharge resistivity Re of the developing roller 10 is set within the range described above, thereby preventing the idle lateral band. With the configuration described above, it is possible to easily move surface charges of the surface treated layer 10*c* of the developing roller 10. Accordingly, the surface charges of the surface treated layer 10*c* of the developing roller 10 easily move to the metal shaft 10*a* as the conductive portion of the developing roller 10. As a result, even when the developing device 4 stops operating for a long period of time, it is possible to prevent a difference in the surface potential of the developing roller 10, and to prevent the idle lateral band.

Further, the partial resistivity, not the corona discharge resistivity, may define the upper limit of the resistivity of the elastic layer 10*b* including the surface treated layer 10*c* for preventing the idle lateral band. In this case, however, the upper limit may vary due to a thickness of the surface treated layer 10*c* or a material of the elastic layer 10*b*, thereby deteriorating applicability.

When the developing device 4 stays in an idle state (an idle operation period) for a long period of time, the idle lateral band may occur due to a different in remaining potentials on the surface of the developing roller 10 between the portions A and B. Accordingly, using the corona discharge, the corona discharge resistivity is most relevant with the dielectric relaxation measurement device capable of measuring the parameters such as the charge decay, the remaining charge, dielectric resistivity, and the like on the developing roller 10. When the partial resistivity defines the upper limit, it is difficult to measure the difference in the remaining charge before and after the idle operation period.

First Experiment

A first experiment was conducted for evaluating a relationship between a surface potential difference of the developing roller 10 and the idle lateral band. In the first experiment, the developing roller 10 was installed in the developing device 4 first, and the developing device 4 was stayed in the idle state for various periods of time, so that the idle lateral band was evaluated in each period. Then, the developing roller 10 was removed from the developing device 4, and the corona discharge resistivity Re and the surface potential Va were measured at the portions A and B facing inside and outside of the casing 4*a*.

In the first experiment, the surface treated layer 10*c* of the developing roller 10 was treated using a urethane solution only. The metal shaft 10*a* of the developing roller 10 had a diameter of 10 mm. The elastic layer 10*b* of the developing roller 10 had a thickness of 4.8 mm and a length of 348 mm. The surface treated layer 10*c* of the developing roller 10 had a thickness of 5 to 10 μm.

In the first experiment, after the image forming apparatus shown in FIG. 1 printed a pattern 60 with a duty of 5% shown in FIG. 8 on 2,000 sheets, the image forming apparatus was stayed in an idle state under a temperature of 20° C. and humidity of 20% for specific periods of time. The duty represents a print density. For example, when a solid image is printed over an entire printable area of a sheet, the duty becomes 100%. During the printing operation of the image forming apparatus, a voltage of −200 V was applied to the developing roller 10; a voltage of −350 V was applied to the toner supply roller 11; a voltage of −1,000 V was applied to the charging roller 8; and a voltage of −350 V was applied to the developing blade 13.

In the first experiment, after the image forming apparatus was stayed in the idle state for the specific periods of time, a print pattern with half-tone was printed, so that the idle lateral band was evaluated using a density step ratio α given by the following equation:

$$\sigma = Da/Db$$

where Da is a density of a lateral ban portion of the print pattern, and Db is a density of an area other than the lateral band portion. The densities Da and Db were measured with a spectrum density meter X-Rite 500 (a product of Canon i-tech, Inc.).

In the first experiment, when the density step ratio σ was less than 1.052 ($\sigma \leqq 1.052$), the idle lateral band was not apparent and it was difficult to visually confirm the idle lateral band, so that a result was determined as good. When the density step ratio σ was greater than 1.07 ($\sigma > 1.07$), the idle lateral band was apparent and it was easy to visually confirm the idle lateral band, so that a result was determined as poor. When the density step ratio σ was between 1.052 and 1.07 ($1.052 < \sigma \leqq 1.07$), the idle lateral band was vague and it was possible to barely confirm the idle lateral band, so that a result was determined as fair.

In the first experiment, after the idle lateral band was evaluated, the developing roller 10 was removed from the developing device 4. Then, the corona discharge resistivity Re and the surface potential Va were measured using a dielectric relaxation measurement device DRA-2000L (a product of Quality Engineering Associates, Inc.), so that ratios Sr and Sv were determined with the following equations:

$$Sr = Rea/Reb$$

$$Sv = V_1/V_2$$

where Rea is an average of the corona discharge resistivity Re in an area where the idle lateral band was generated; Reb is an average of the corona discharge resistivity Re in an area where the idle lateral band was not generated; $V_1$ is an average of the surface potential Va in the area where the idle lateral band was generated; and $V_2$ is an average of the surface potential Va in the area where the idle lateral band was not generated.

In the measurement, the corona voltage was 6 kV, and a sampling was conducted with an interval of 0.1 mm in the axial direction and an interval of 6 degrees in the circumferential direction. The carrier 50 was set to move at a speed of 151.3 mm/sec. in the axial direction. Further, the cut-off voltage $V_{mx}$ was set at 0.91 kV, and the maximum current density $J_{mx}$ was set at 23.97 μA/cm$^2$. The measurement result was obtained as an average of measured values of measurement points.

In the first experiment, the measurement was repeated with various idle operation periods, so that the idle lateral band was evaluated with the ratios Sr and Sv as parameters. Table 1 shows results of the first experiment.

TABLE 1

| Sr | 1 | 1.05 | 1.1 | 1.15 | 1.2 | 1.25 | 1.3 | 1.35 | 1.4 |
|---|---|---|---|---|---|---|---|---|---|
| Result | Good | Good | Good | Good | Fair | Fair | Poor | Poor | Poor |
| Sr | 1.45 | 1.5 | 1.55 | 1.6 | 1.65 | 1.7 | 1.75 | 1.8 | 1.85 |
| Result | Poor | Poor | Poor | Poor | Poor | Poor | Poor | Poor | Poor |

TABLE 1-continued

| Sv | 1 | 1.05 | 1.1 | 1.15 | 1.2 | 1.25 | 1.3 | 1.35 | 1.4 |
|---|---|---|---|---|---|---|---|---|---|
| Result | Good | Good | Good | Good | Good | Good | Good | Good | Fair |
| Sv | 1.45 | 1.5 | 1.55 | 1.6 | 1.65 | 1.7 | 1.75 | 1.8 | 1.85 |
| Result | Fair | Fair | Fair | Fair | Fair | Fair | Fair | Poor | Poor |

As shown in Table 1, when the ratio Sr decreased to 1.25, the idle lateral band became vague. When the ratio Sr became 1.15, the idle lateral band was not generated. When the ratio Sv decreased to 1.75, the idle lateral band became vague. When the ratio Sr became 1.35, the idle lateral band was not generated.

Second Experiment

A second experiment was conducted for evaluating the idle lateral band of the developing roller 10. In the second experiment, nine types of the developing roller 10 were prepared. Each of the developing roller 10 included the elastic layer 10*b* having an electrical resistivity varied through changing a composition ratio of carbon black. First, the corona discharge resistivity Re and the partial resistivity of the developing roller 10 were measured. Then, the developing roller 10 was installed in the image forming apparatus, and the printing operation was conducted. After the image forming apparatus was placed for 96 hours, the printing operation was conducted, so that the idle lateral band was evaluated.

In the second experiment, the developing roller 10 included the surface treated layer 10*c* similar to that in the first experiment. The image forming apparatus was operated in a way similar to that in the first experiment. A method of evaluating the idle lateral band was similar to that in the first experiment.

In the second experiment, ball bearings having an outer diameter of 6 mm and a width of 1.5 mm were arranged at six locations along the developing roller 10 in a longitudinal direction thereof. The ball bearings were pressed against the surface treated layer 10*c* with a force of 20.0 gf. Then, a direct current of −100 V was applied between each of the ball bearings and the metal shaft 10*a*, so that resistivity was measured at the six locations. The partial resistivity was obtained as an average of the resistivity thus measured.

Table 2 shows results of the second experiment.

TABLE 2

| | 1 | 2 | 3 | 4 | 5 | 6 | 7 | 8 | 9 |
|---|---|---|---|---|---|---|---|---|---|
| Partial resistivity (log Ω) | 5.48 | 5.89 | 6.66 | 7.00 | 7.40 | 7.54 | 7.96 | 8.99 | 9.43 |
| Corona discharge resistivity (log Ω) | 7.34 | 7.48 | 7.61 | 7.70 | 7.75 | 7.76 | 7.85 | 8.01 | 8.09 |
| Surface potential (V) | 1.28 | 1.55 | 2.58 | 3.00 | 4.40 | 4.87 | 7.58 | 16.57 | 27.69 |
| Sr | 0.99 | 1.05 | 1.09 | 1.13 | 1.15 | 1.16 | 1.23 | 1.35 | 1.52 |
| Sv | 1.00 | 1.09 | 1.12 | 1.24 | 1.32 | 1.37 | 1.57 | 2.16 | 3.21 |
| Result | Good | Good | Good | Good | Good | Fair | Fair | Poor | Poor |

As shown in Table 2, when the corona discharge resistivity Re was lowered to 7.85 log Ω, the idle lateral band became vague. When the corona discharge resistivity Re became 7.75 log Ω, the idle lateral band was not generated.

Third Experiment

A third experiment was conducted for evaluating the upper limit of the corona discharge resistivity Re with a difference in the surface treated layer 10*c*. In the third experiment, the surface of the elastic layer 10*b* was treated using the urethane solution containing fluoride.

In the third experiment, the developing roller 10 included the elastic layer 10*b* similar to that in the second experiment. The image forming apparatus was operated in a way similar to that in the first experiment. A method of evaluating the idle lateral band was similar to that in the first experiment.

Table 3 shows results of the second experiment.

TABLE 3

| | 1 | 2 | 3 | 4 | 5 | 6 | 7 | 8 | 9 |
|---|---|---|---|---|---|---|---|---|---|
| Partial resistivity (log Ω) | 5.37 | 5.76 | 6.58 | 7.12 | 7.40 | 7.60 | 8.00 | 9.12 | 9.50 |
| Corona discharge resistivity (log Ω) | 7.35 | 7.52 | 7.68 | 7.70 | 7.84 | 7.89 | 7.96 | 8.26 | 8.40 |
| Surface potential (V) | 1.40 | 2.01 | 2.87 | 3.92 | 4.99 | 5.36 | 8.84 | 18.87 | 31.68 |
| Sr | 0.99 | 1.05 | 1.11 | 1.14 | 1.16 | 1.20 | 1.27 | 1.38 | 1.55 |
| Sv | 1.04 | 1.10 | 1.20 | 1.31 | 1.36 | 1.43 | 1.74 | 2.32 | 3.38 |
| Result | Good | Good | Good | Good | Fair | Fair | Poor | Poor | Poor |

As shown in Table 3, when the corona discharge resistivity Re was lowered to 7.89 log Ω, the idle lateral band became vague. When the corona discharge resistivity Re became 7.70 log Ω, the idle lateral band was not generated. When the surface of the elastic layer 10*b* was treated using the urethane solution containing fluoride, the developing roller 10 is provided with good insulation property. Accordingly, the corona discharge resistivity Re increased, and an image density improved.

In the embodiments described above, the developing roller 10 is formed of the supporting layer including the elastic layer 10*b* and the surface treated layer 10*c*. Alternatively, the supporting layer may not be formed of a plurality of layers, as far as the supporting layer has the corona discharge resistivity Re in the specific range described above. Further, the supporting layer may be formed in a belt shape.

In the embodiments described above, the present invention is applied to the printer, and is applicable to a copier, facsimile, a multi-function product, and the likes.

The disclosure of Japanese Patent Application No. 2008-328973, filed on Dec. 25, 2008, is incorporated in the application by reference.

While the invention has been explained with reference to the specific embodiments of the invention, the explanation is illustrative and the invention is limited only by the appended claims.

What is claimed is:

1. A developer supporting member comprising:

a supporting layer for supporting developer, said supporting layer having a corona discharge resistivity having a common logarithm value of less than 7.89 (log Ω).

2. The developer supporting member according to claim 1, wherein said supporting layer is formed of an elastic layer and a surface layer.

3. The developer supporting member according to claim 2, where said surface layer includes a surface treated with a urethane solution.

4. The developer supporting member according to claim 2, where said surface layer includes a surface treated with a urethane solution containing fluoride.

5. The developer supporting member according to claim 2, wherein said elastic layer is formed of a urethane rubber.

6. The developer supporting member according to claim 2, wherein said elastic layer is formed of a urethane rubber containing carbon black.

7. The developer supporting member according to claim 1, further comprising a conductive portion, said supporting layer being disposed on the conductive portion.

8. The developer supporting member according to claim 7, wherein said conductive portion is formed of a shaft.

9. The developer supporting member according to claim 1, wherein said supporting layer has the corona discharge resistivity having a common logarithm value of less than 7.85 (log Ω).

10. The developer supporting member according to claim 9, wherein said supporting layer has the corona discharge resistivity having a specific ratio Sr between 0.99 and 1.23, said ratio being expressed with the following equation:

$$Sr=Rea/Reb$$

where Rea is an average value of the corona discharge resistivity in an area inside a developing device, and Reb is an average value of the corona discharge resistivity in an area outside the developing device.

11. The developer supporting member according to claim 10, wherein said supporting layer has the corona discharge resistivity having the specific ratio Sr between 0.99 and 1.15.

12. A developing roller comprising a conductive shaft and the developer supporting member according to claim 1, said developer supporting member being disposed on the conductive shaft.

13. A developing device comprising the developing roller according to claim 12.

14. An image forming apparatus comprising the developing device according to claim 13, and a transfer device for transferring a developer image formed with the developing device.

15. The developer supporting member according to claim 1, wherein said supporting layer has the corona discharge resistivity having a specific ratio Sr between 0.99 and 1.20, said ratio being expressed with the following equation:

$$Sr=Rea/Reb$$

where Rea is an average value of the corona discharge resistivity in an area inside a developing device, and Reb is an average value of the corona discharge resistivity in an area outside the developing device.

16. The developer supporting member according to claim 15, wherein said supporting layer has the corona discharge resistivity having the specific ratio Sr between 0.99 and 1.14.

* * * * *